US006612239B2

(12) United States Patent
Reichel et al.

(10) Patent No.: US 6,612,239 B2
(45) Date of Patent: Sep. 2, 2003

(54) DEVICE FOR FASTENING A TENSION-MOUNTED COVERING ON A PRINTING-UNIT CYLINDER

(75) Inventors: Klaus T. Reichel, Augsburg (DE); Peter Knauer, Münster/Lech (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/015,962

(22) Filed: Dec. 10, 2001

(65) Prior Publication Data

US 2002/0078846 A1 Jun. 27, 2002

(30) Foreign Application Priority Data

Dec. 8, 2000 (DE) ..... 100 60 984

(51) Int. Cl.[7] ..... B41F 27/12
(52) U.S. Cl. ..... 101/415.1; 101/378; 101/383
(58) Field of Search ..... 101/415.1, 378, 101/375, 376, 216, 217, 382.1, 383, 384

(56) References Cited

U.S. PATENT DOCUMENTS

| | | | | |
|---|---|---|---|---|
| 4,214,530 A | | 7/1980 | Signorelli et al. | 101/415.1 |
| 5,213,038 A | | 5/1993 | Takahashi et al. | 101/410 |
| 5,483,891 A | * | 1/1996 | Reichel | 101/415.1 |
| 5,613,440 A | | 3/1997 | Rau | 101/415.1 |
| 5,778,786 A | | 7/1998 | Metrope | 101/415.1 |
| 6,240,845 B1 | | 6/2001 | Koppelkamm | 101/415.1 |

FOREIGN PATENT DOCUMENTS

| | | | | |
|---|---|---|---|---|
| DE | 146 161 | | 1/1981 | |
| DE | 261 764 | | 11/1988 | |
| DE | 261 765 A1 | * | 11/1988 | 101/415.1 |
| DE | 261 766 A1 | * | 11/1988 | 101/415.1 |
| DE | 262 192 A1 | * | 11/1988 | 101/415.1 |
| DE | 38 12 137 | | 1/1989 | B41F/27/12 |
| DE | 43 35 140 | | 2/1995 | B41F/27/12 |
| DE | 197 01 046 | | 7/1997 | B41F/27/12 |
| GB | 2 167 011 A | * | 5/1986 | |
| GB | 2 206 534 A | * | 1/1989 | |

* cited by examiner

*Primary Examiner*—Leslie J. Evanisko
(74) *Attorney, Agent, or Firm*—Cohen, Pontani, Lieberman & Pavane

(57) ABSTRACT

In order to reliably tension the legs of the carrier plate by means of tongues fastened to spindles, one spindle is designed as a hollow spindle which is mounted in a bore of the cylinder gap of the printing-unit cylinder, and the other spindle is mounted in the hollow spindle.

14 Claims, 5 Drawing Sheets

DEVICE FOR FASTENING A TENSION-MOUNTED COVERING ON A PRINTING-UNIT CYLINDER

BACKGROUND OF THE INVENTION

1. Field of the Invention

The invention relates to a device for fastening a tension-mounted covering on a printing-unit cylinder of a printing machine, the cylinder having an axis and at least one cylinder gap comprising a bore extending in the axial direction, the tension-mounted covering comprising a flexible carrier plate having a leading bent leg and a trailing bent leg, the legs being insertable in the cylinder gap. The tension-mounted covering may be, for example, a flexible printing plate a rubber-blanket unit consisting of a flexible carrier plate and of a rubber coating.

2. Description of the Related Art

U.S. Pat. No. 5,213,038 discloses a plate tension-mounting, in which the forme cylinder has a cylinder gap which runs in the axial direction and one edge of which carries the leading plate leg. The cylinder gap also contains a rotatable spindle, on which U-shaped leaf springs are arranged so as to be distributed over the width of the forme cylinder. One leg of the leaf springs is bent in a hook-shaped manner and, during the rotation of the spindle, engages into the trailing plate leg likewise bent in a hook-shaped manner. The other leg of the spring presses the leading plate leg against the wall of the cylinder gap. One disadvantage of this device is that the tension-mounting of the first plate leg has to be released again in order to introduce the second plate leg. Moreover, the tensioning forces which are to be set for the two plate legs by means of a spindle position exert an adverse influence on one another. Also, the device requires a wide clearance in the cylinder outer surface, thus giving rise to vibrations during printing and narrowing the cylinder outer surface available for printing.

U.S. Pat. No. 6,240,845 discloses a device for fastening a flexible printing forme on a forme cylinder, the device having two spindles in a bore of a cylinder gap. Each spindle carries leaf springs which, during the pivoting of the spindle, are capable of being moved towards a gap wall in each case and at the same time in each case fix to the latter one leg of the printing plate. The leaf springs and plate legs are provided with curvatures and the gap walls with recesses. The spindles are mounted on one side in a bearer ring and are supported in the bore by means of pins.

SUMMARY OF THE INVENTION

The object of the invention is to provide a device for fastening a tension-mounted covering on a printing-unit cylinder, the device reliably tensioning the legs of the tension-mounted covering.

The device according to the invention includes a hollow first spindle pivotably mounted in the bore, first pivotable tongues fastened to the first spindle for tensioning one of the leading bent leg and the trailing bent leg, a second spindle pivotably mounted in the first spindle, and second pivotable tongues fastened to second spindle for tensioning the other of the lending bent leg and the trailing bent leg.

On account of the two spindles, the leading leg does not need to be released again in order to introduce the trailing leg into the cylinder gap. Moreover, the tensioning forces for the legs of the carrier plate can be selected and applied, independently of one another, by appropriate individual rotation of the spindles. The device is distinguished by a compact form of construction, the spindle and hollow spindle being mounted in a stable and low-flexion manner. The clearance in the cylinder gap can have a narrow dimensioning, so that a low-vibration running of the printing-unit cylinders becomes possible. Moreover, the print-free region on the web to be printed is kept small.

In a design variant, the trailing leg is drawn into the tensioning gap, with the result that thermal expansions are effectively compensated.

The device is suitable for carrying out a partly or fully automatic printing-plate change. The web does not have to be removed from the printing machine for a printing-plate change.

Further features and advantages may be gathered from the subclaims in conjunction with the description.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
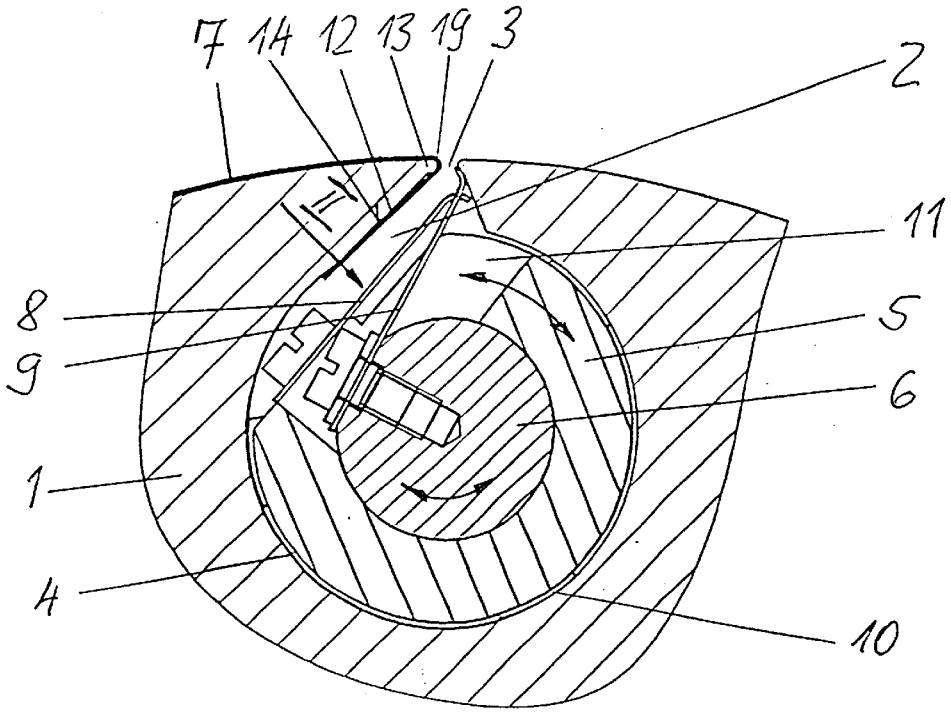
FIG. 1 shows a device for fastening a printing forme on a forme cylinder.
Figure 2:
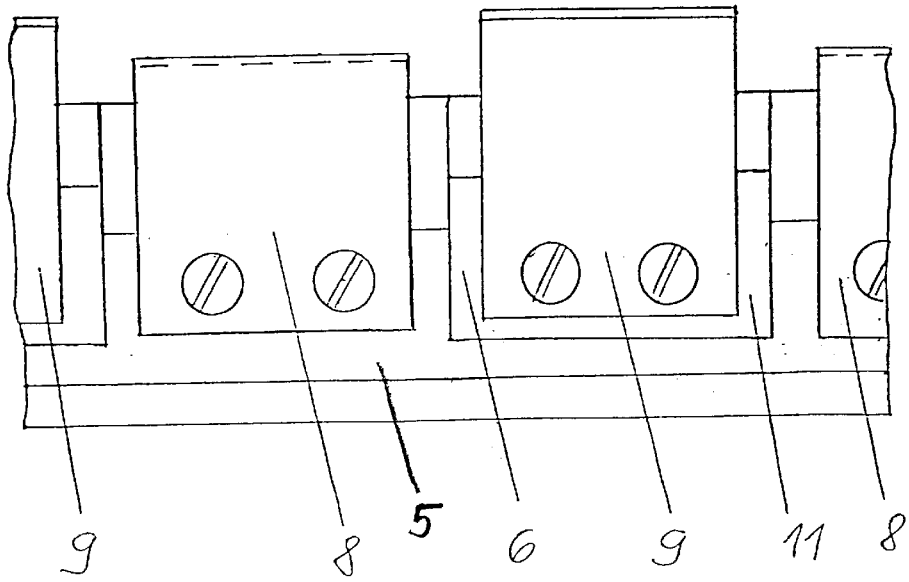
FIG. 2 shows the view II according to FIG. 1.

The forme cylinder 1, a detail of which is shown in FIG. 1, contains a cylinder gap 2 with a channel 3 and with a bore 4 which run in the axial direction of the forme cylinder 1. A hollow spindle 5 is mounted in the bore 4 and, in turn, a further spindle 6 is mounted in a bore in the hollow spindle 5, in each case pivotably. First tongues 8 are screwed to the hollow spindle Sand second tongues 9 to the further spindle 6, in each case so as to be distributed over the width of the printing plate 7 to be tensioned or of the forme cylinder 1 (see FIG. 2). First and second tongues 8, 9 are arranged alternately in the axial direction of the forme cylinder 1. The hollow spindle 5 has a plurality of axially spaced radial recesses 11 which intersect the bore in the hollow spindle; the second tongues 9 fastened to the further spindle 6 pass through the recesses 11. The first and second tongues 8, 9 are advantageously designed as leaf springs, that is to say resiliently. It is thereby possible for forces to act upon the legs of the printing plate 7 particularly uniformly over the entire width of the printing plate 7. This avoids plate breaks and increases the reliability of the tension-mounting device.

Figure 5:
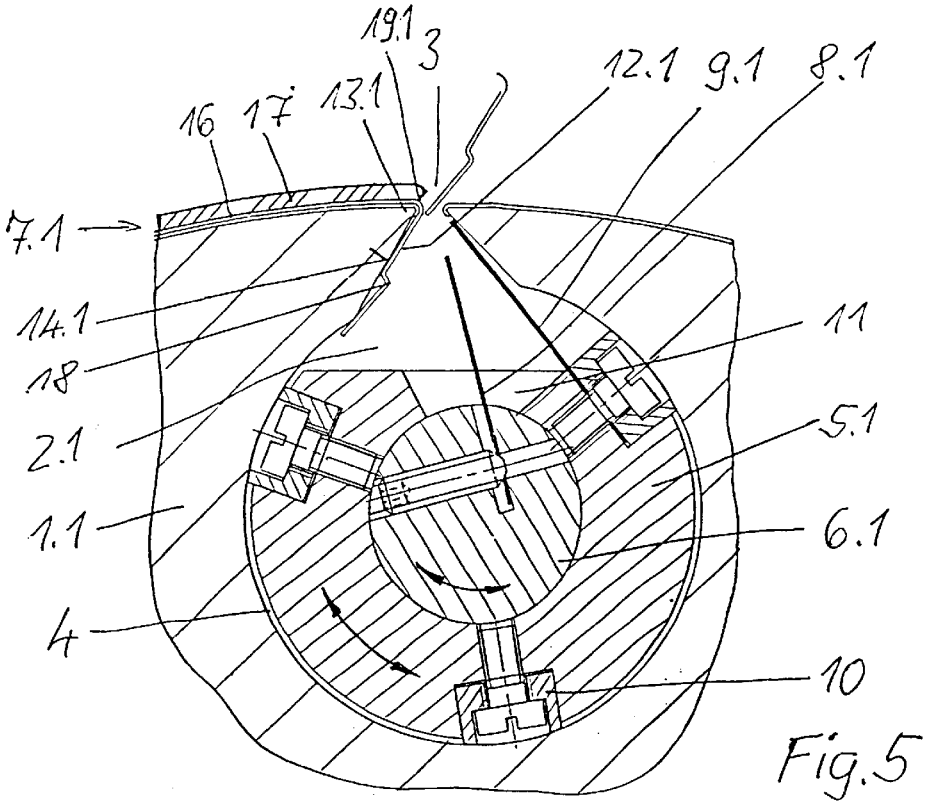

The hollow spindle 5 is supported in the bore 4 by means of supporting elements 10 distributed on the circumference (see FIG. 5). The supporting elements 10 are arranged at least approximately in the middle of the length of the hollow spindle 5, with the result that the flexion of the hollow spindle 5 is kept low and a stable clamping of the printing plate 7 is implemented. The supporting elements 10 can be mounted vertically adjustably, so that manufacturing tolerances of the bore 4 can be compensated. A jam-free pivoting of the hollow spindle 5 thereby becomes possible.

Figure 3:
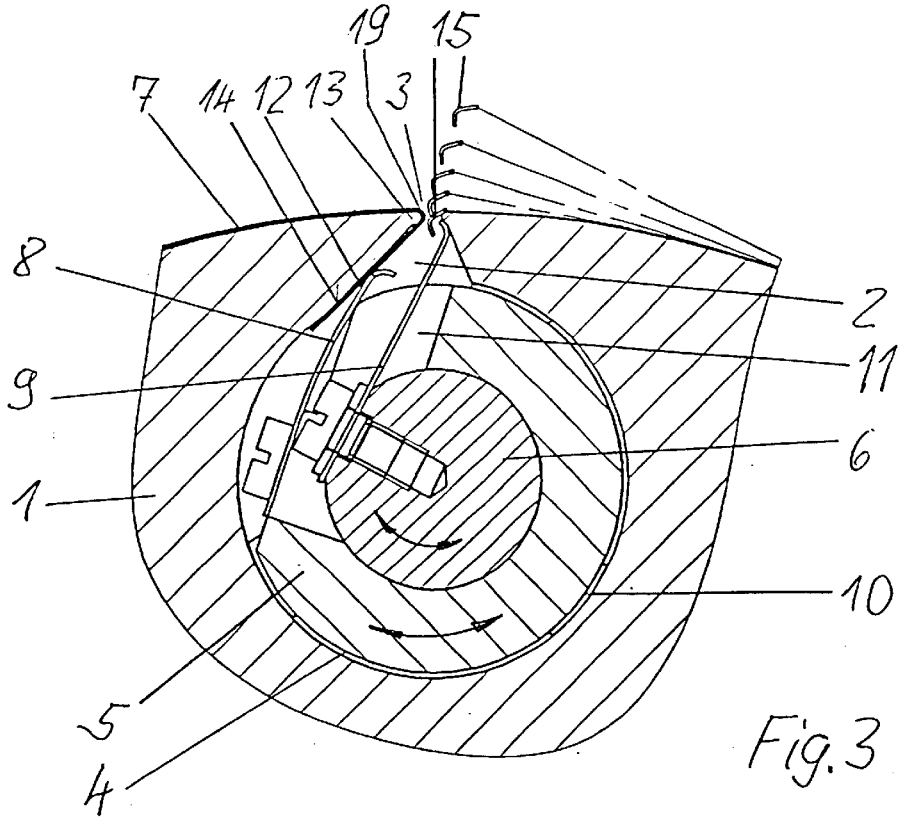
FIGS. 3 and 4 show further positions of the device according to FIG. 1, FIGS. 5 to 7 show a device for fastening a rubber-blanket unit on a transfer cylinder in a further design variant to FIG. 1, and FIGS. 8 to 10 show a further design variant to the device according to FIG. 1.
Figure 4:
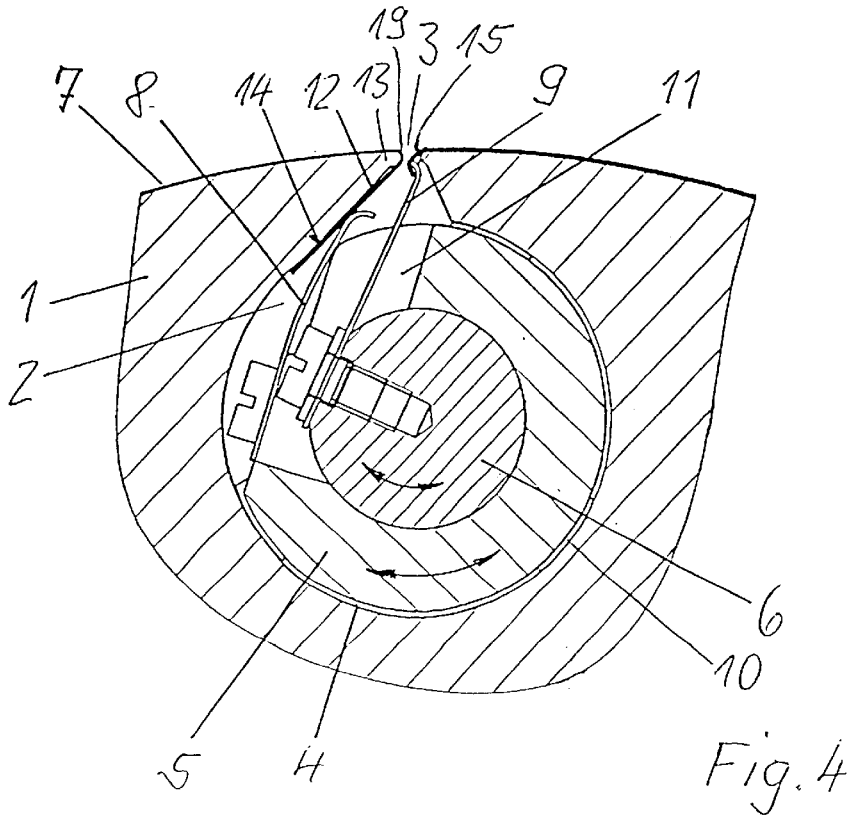

In the positions of the hollow spindle 5 and spindle 6 which are shown in FIG. 1, the printing plate 7 is inserted with its leading leg 12 into the cylinder gap 2 and is suspended with its bend 19 on the leading edge 13 of the cylinder gap 2. During the subsequent rotation of the hollow spindle 5 into the position shown in FIG. 3, the first tongues 8 press the leading leg 12 against a first gap wall 14 terminating at an acute angle to the cylinder outer surface and thus tension the leading leg 12. The printing plate 7 thus fixed is subsequently wound around the forme cylinder 1. This is advantageously carried out by the forme cylinder 1 being rotated, optionally the printing plate 7 being pressed against the latter by means of pressure rollers. At the end of this winding operation, the trailing leg 15 of the printing plate 7 is pressed into the cylinder gap 2 (FIG. 3). The spindle 6 is then pivoted into the position shown in FIG. 4, its second tongues 9, with their ends bent approximately at 90° in a hook-shaped manner, gripping the trailing leg 15 of the printing plate 7 and tensioning the latter.

The separate drives for the hollow spindle 5 and the spindle 6 may be distributed on both sides of the printing unit, for example the drive for the hollow spindle 5 on the operating side (SI) and the drive for the spindle 6 on the driving side (SII).

The trailing leg 15 automatically enters the cylinder gap 2 during the tensioning of the printing plate 7, as illustrated in steps in FIG. 3. For this purpose, the trailing leg is advantageously made very short, with the result that faults due to upsetting or the like are also avoided. The device is thereby also appropriate for a fully automatic printing-plate change. In this case, the leading leg 12 is also suspended automatically in the cylinder gap 2, for example by means of a robot, at the commencement of the printing-plate changing operation.

The removal of the printing plate 7 takes place in reverse order. In the first place, therefore, the spindle 6 is rotated clockwise into the position shown in FIG. 1. At the same time, its second tongues 9 release the trailing leg 15 of the printing plate 7, the trailing leg thereupon jumping out of the cylinder gap 2 or being capable of being extracted from the latter. The unwinding of the printing plate 7 from the forme cylinder 1 subsequently takes place. The hollow spindle 5 is thereafter rotated clockwise into the position shown in FIG. 1, the leading leg 12 being released and the printing plate 7 being removable from the forme cylinder 1.

Figure 6:
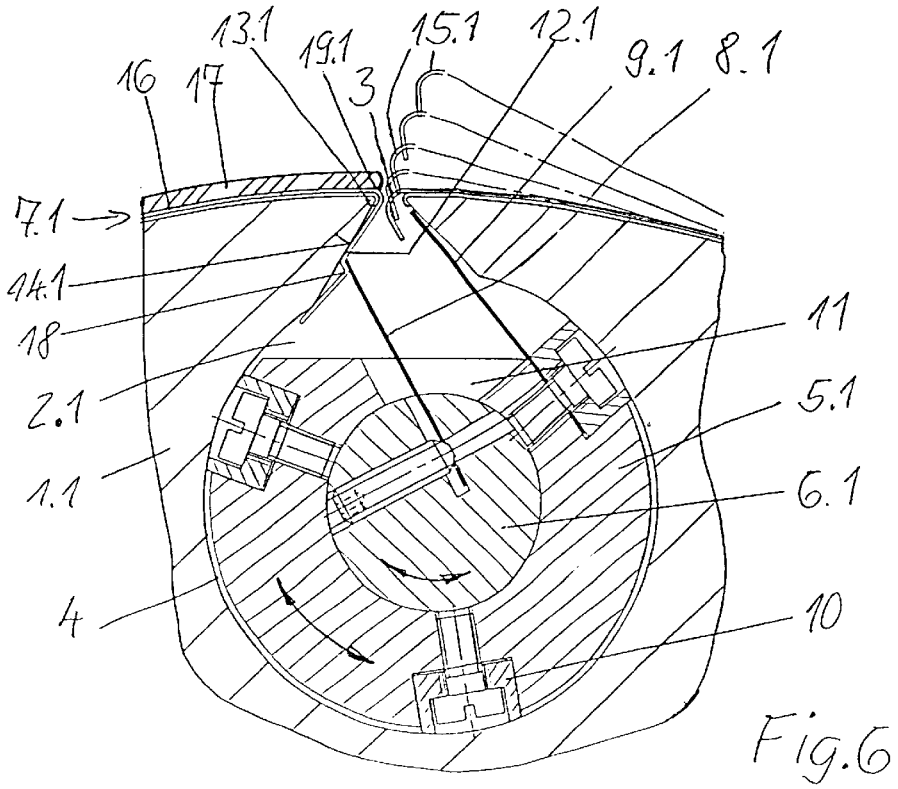
Figure 7:
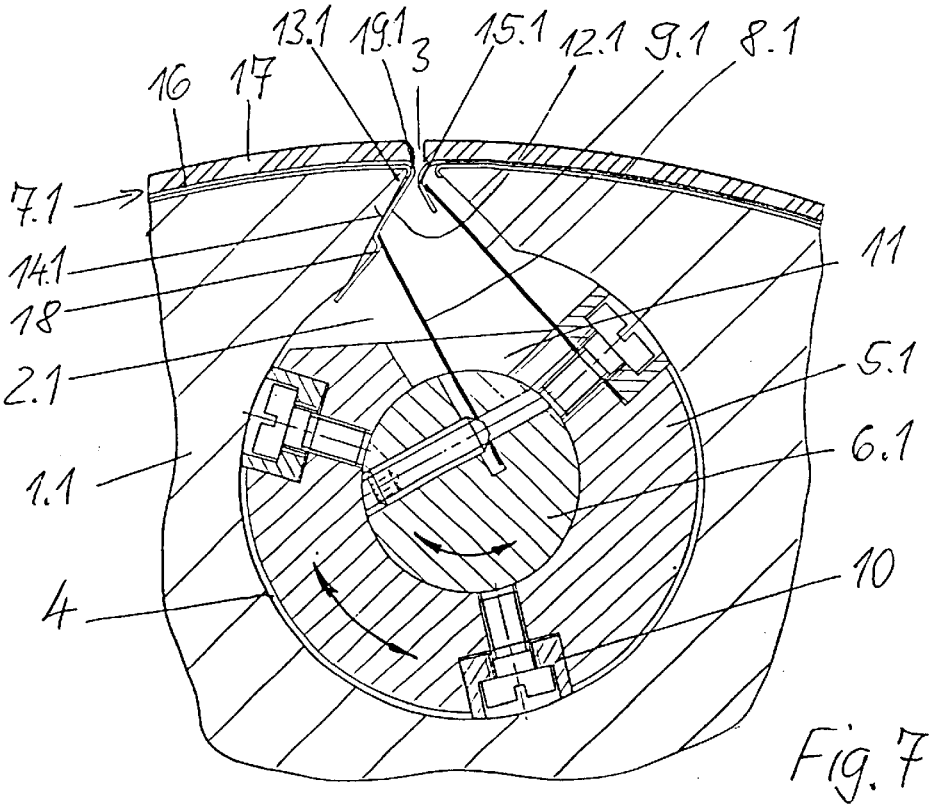

FIGS. 5 to 7 show a further variant of a device to FIGS. 1 to 4, this variant being explained by the example of the fastening of a rubber-blanket unit on a transfer cylinder. For the sake of simplicity, the reference symbols used hitherto are largely retained for this and the subsequent exemplary embodiment, if appropriate with the addition ".1, .2" being appended. The cylinder gap 2.1 of a transfer cylinder 1.1 again has a bore 4, in which is mounted a hollow spindle 5.1 in which a further spindle 6.1 is mounted. The hollow spindle 5.1 and the spindle 6.1 are pivotable independently of one another. The hollow spindle 5.1 is mounted in the bore 4 by means of supporting elements 10. In contrast to the previous exemplary embodiment, the first tongues 8.1 are screwed to the spindle 6.1 and the second tongues 9.1 to the hollow spindle 5.1. The tongues 8.1 and 9.1 are again arranged so as to be distributed over the length of the transfer cylinder 1.1 and in an alternating sequence. The first tongues 8.1 enter recesses 11 of the hollow spindle 5.1 through the latter.

The rubber-blanket unit 7.1 consists of a carrier plate 16, on which a rubber blanket 17 is fastened, with the exception of the leading and trailing legs 12.1, 15.1. The leading leg 12.1 has an, in particular, V-shaped notch 18. The device is otherwise largely identical to the device described above (FIGS. 1 to 4), and there is therefore no need for repetitive explanations.

For the purpose of mounting the rubber-blanket unit 7.1 onto the transfer cylinder 1.1, in the positions of a hollow spindle 5.1 and spindle 6.1 which are shown in FIG. 5, the leading leg 12.1 is introduced into the cylinder gap 2.1 at the channel 3 and the rubber-blanket unit 7.1 is suspended with its bend 19.1 on the leading edge 13.1 of the cylinder gap 2.1. Subsequently, as a result of pivoting of the spindle 6.1, the first tongues 8.1 are moved towards the leading leg 12.1, the tongues 8.1 gripping the latter at the notch 18 and drawing it into the cylinder gap 2.1. Finally, in this case, the leading leg 12.1 and the first tongues 8.1 assume the position shown in FIG. 6, the rubber-blanket unit 7.1 being drawn with its bend 19.1 onto the leading edge 13.1, aligned and reliably tensioned there and also pressed against the first gap wall 14.1. The second tongues 9.1 are still in the position depicted in FIG. 5. The rubber-blanket unit 7.1 is then wound around the transfer cylinder 1.1, and, finally, the trailing leg 15.1 is pressed into the cylinder gap 2.1 (FIG. 6). The hollow spindle 5.1 is subsequently pivoted anticlockwise, with the result that the second tongues 9.1 come into engagement with the trailing leg 15.1, draw the latter into the cylinder gap 2.1 and tension it, as shown in FIG. 7. The demounting of the rubber-blanket unit 7.1 takes place in reverse order to mounting.

Figure 8:
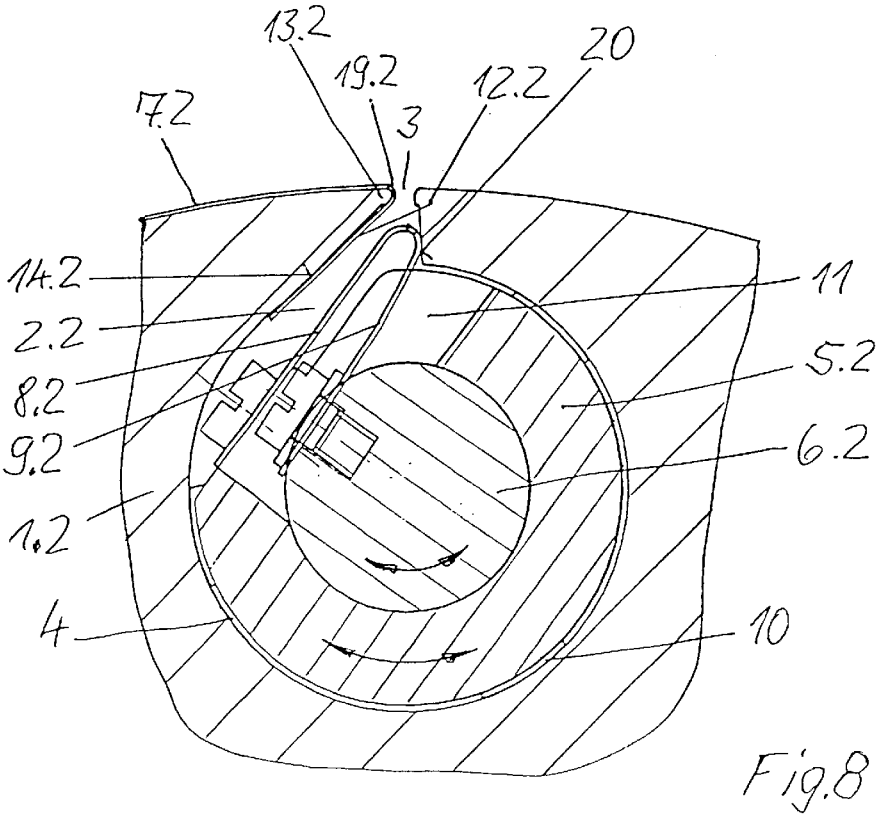
Figure 9:
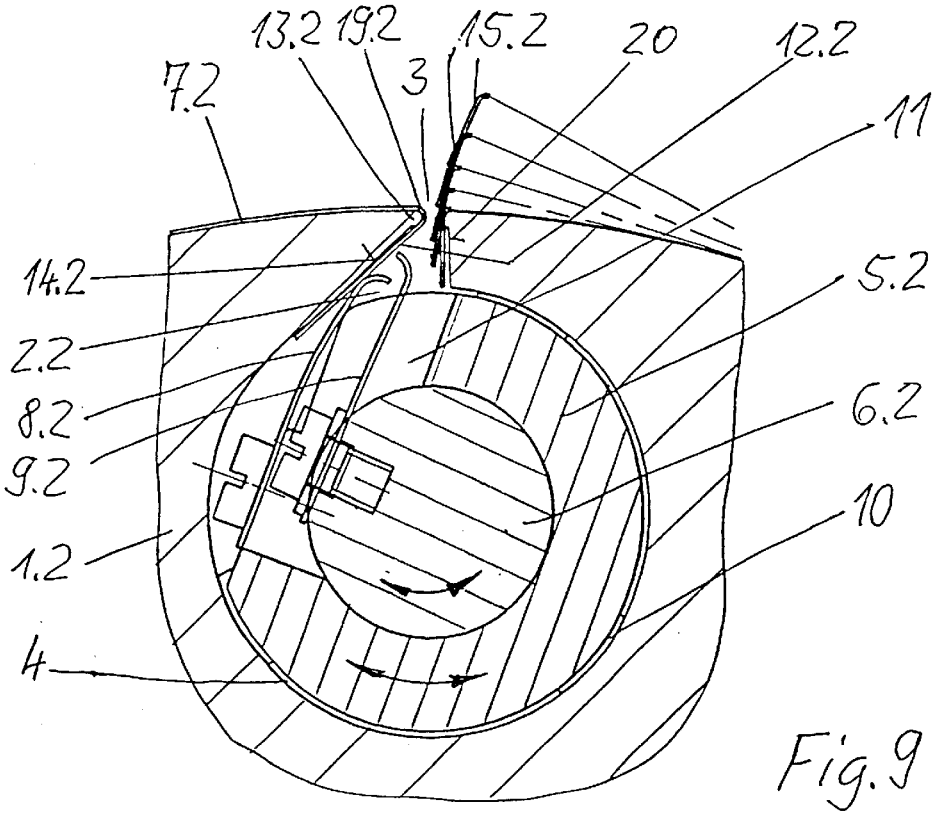
Figure 10:
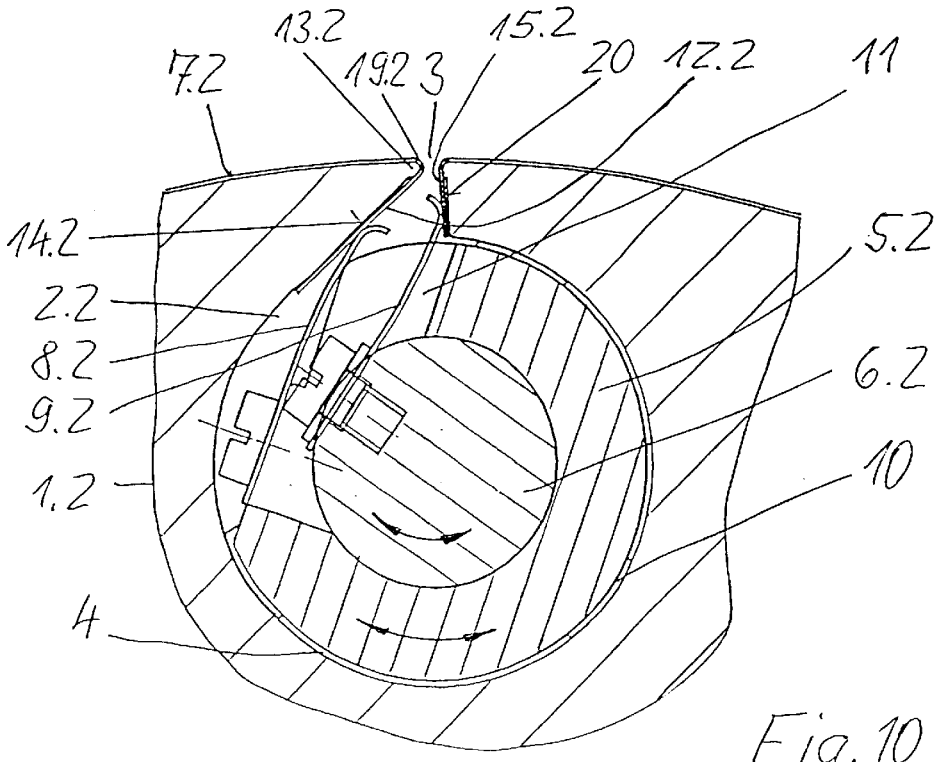

FIGS. 8 to 10 show a further exemplary embodiment of a device for the tensioning of a printing plate 7.2. The forme cylinder 1.2 has a cylinder gap 2.2 with a bore 4 in which is mounted a hollow spindle 5.2 in which, in turn, a further spindle 6.2 is mounted. The hollow spindle 5.2 is supported in the bore 4 by means of supporting elements 10. First tongues 8.2 are screwed to the hollow spindle 5.2 and second tongues 9.2 to the spindle 6.2, all the tongues 8.2, 9.2 again being arranged in alternating order over the width of the forme cylinder 1.2. The second tongues 9.2 pass through the hollow spindle 5.2 in recesses 11.

For the purpose of mounting the printing plate 7.2, first its leading leg 12.2 is inserted into the cylinder gap 2.2 at the channel 3, with the hollow spindle 5.2 and the spindle 6.2 being in the positions shown in FIG. 8, and the printing plate 7.2 is suspended with its bend 19.2 on the leading edge 13.2 of the cylinder gap 2.2. The hollow spindle 5.2 is subsequently pivoted anticlockwise into the position depicted in FIG. 9, the first tongues 8.2 pressing the leading leg 12.2 against the first gap wall 14.2 and reliably tensioning this leg. The further spindle 6.2 has in the meantime been or is then also pivoted anti-clockwise, its second tongues 9.2 assuming the position shown in FIG. 9. The printing plate 7.2 is then wound around the forme cylinder 1.2, at the end of which winding operation the trailing leg 15.2 of the printing plate 7.2 enters the cylinder gap 2.2 and assumes the position depicted in FIG. 9. The spindle 6.2 is subsequently pivoted clockwise, its second tongues 9.2 pressing the trailing leg 15.2 of the printing plate against a second gap wall 20 and reliably tensioning this leg. The tensioned state, shown in FIG. 10, of the device for the printing plate 7.2 is then reached. The demounting of the printing plate 7.2 takes place in reverse order to its mounting.

The devices described for the fastening of printing plates 7, 7.2 may also be used for the fastening of rubber-blanket units and, conversely, the device described for fastening a rubber-blanket unit 7.1 may also be used for the fastening of printing plates. Also, the features of the exemplary embodiments can be combined with one another to form further variants.

The invention can also be employed when the circumference of the printing-unit cylinder 1, 1.1, 1.2 has arranged on it a plurality of cylinder gaps 2, 2.1, 2.2, into which in each case a leading and a trailing leg 12, 12.1, 12.2, 15, 15.1, 15.2 of two adjacent tension-mounted coverings to be fastened are inserted.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. Apparatus for fastening a tension-mounted covering on a printing-unit cylinder of a printing machine, said cylinder having an axis and at least one cylinder gap comprising a bore extending in the axial direction, said tension-mounted covering comprising a flexible carrier plate having a leading bent leg and a trailing bent leg, said legs being insertable in said cylinder gap, said apparatus comprising a first spindle which can be pivotably mounted in said bore of said cylinder, said first spindle having a bore and a plurality of axially spaced radial recesses which intersect said bore of said first spindle, first pivotable tongues fastened to said first spindle for tensioning one of said leading bent leg and said trailing bent leg, a second spindle pivotably mounted in said bore of said first spindle, and second pivotable tongues fastened to said second spindle and passing through said recesses of said first spindle for tensioning the other of said leading bent leg and said trailing bent leg.

2. Apparatus as in claim 1 wherein the first and second tongues alternate in the axial direction of the printing unit cylinder.

3. Apparatus as in claim 1 wherein at least one of the first tongues and the second tongues are resilient.

4. A printing unit cylinder assembly for a printing machine, said assembly comprising:

a printing cylinder having an outer surface and an axis and at least one cylinder gap comprising a bore extending in the axial direction, a tension-mounted covering comprising a flexible carrier plate having a leading bent leg and a trailing bent leg, said legs being insertable in said cylinder gap, a first spindle pivotably mounted in said bore, said first spindle having a bore and a plurality of axially spaced radial recesses which intersect said bore of said first spindle, a plurality of first pivotable tongues fastened to said first spindle for tensioning one of said leading bent leg and said trailing bent leg, a second spindle pivotably mounted in said bore of said first spindle, and a plurality of second pivotable tongues fastened to said second spindle and passing through said recesses of said first spindle for tensioning the other of said leading bent leg and said trailing bent leg.

5. A printing unit cylinder assembly as in claim 4 wherein said cylinder gap comprises a cylinder gap wall which extends at an acute angle to said outer surface, said leading leg being pressable against said first cylinder gap wall by one of said first tongues and said second tongues.

6. A printing unit cylinder assembly as in claim 4 wherein said leading leg comprises means for being positively gripped by one of said first tongues and said second tongues and being drawn into said cylinder gap.

7. A printing unit cylinder assembly as in claim 6 wherein said means for being positively gripped comprises a notch in said leading leg.

8. A printing unit cylinder assembly as in claim 4 wherein said trailing leg comprises means for being positively gripped by one of said first tongues and said second tongues and being drawn into said cylinder gap.

9. A printing unit cylinder assembly as in claim 4 wherein said means for being positively gripped comprises a bend of approximately ninety degrees in said trailing leg.

10. A printing unit cylinder assembly as in claim 4 wherein the first and second tongues alternate in the axial direction of the printing unit cylinder.

11. A printing unit cylinder assembly as in claim 4 wherein at least one of the first tongues and the second tongues are resilient.

12. A printing unit cylinder assembly as in claim 4 wherein the tension mounted covering is a printing plate.

13. A printing unit cylinder assembly as in claim 4 wherein the tension-mounted covering is a rubber blanket unit comprising a rubber blanket fixed to said flexible carrier plate.

14. A printing unit cylinder assembly as in claim 4 wherein said first pivotable tongues tension said leading bent leg and said second pivotable tongues tension said trailing bent leg.

* * * * *